United States Patent [19]

Jürgens: et al.

[11] Patent Number: 4,460,053

[45] Date of Patent: Jul. 17, 1984

[54] DRILL TOOL FOR DEEP WELLS

[75] Inventors: Rainer Jürgens, Altencelle; Hermann Rathkamp, Celle, both of Fed. Rep. of Germany

[73] Assignee: Christensen, Inc., Salt Lake City, Utah

[21] Appl. No.: 292,778

[22] Filed: Aug. 14, 1981

[51] Int. Cl.[3] ..... E21B 10/50

[52] U.S. Cl. ..... 175/329; 76/108 A

[58] Field of Search ..... 175/329, 330, 339, 340, 175/393, 409–411; 76/108 A, 101 E, 108 R; 51/309

[56] References Cited

U.S. PATENT DOCUMENTS

| | | | |
|---|---|---|---|
| 3,080,009 | 3/1963 | Baker | 76/108 R |
| 3,112,803 | 12/1963 | Rowley | 175/329 |
| 4,098,363 | 7/1978 | Rohde et al. | 175/329 |
| 4,116,289 | 9/1978 | Feenstra | 175/329 |
| 4,234,048 | 11/1980 | Rowley | 175/329 |
| 4,350,215 | 9/1982 | Radtke | 76/108 A X |
| 4,365,679 | 12/1982 | van Nederveen et al. | 76/108 A X |

*Primary Examiner*—Ernest R. Purser
*Assistant Examiner*—Thuy M. Bui
*Attorney, Agent, or Firm*—Rufus M. Franklin

[57] ABSTRACT

A rotary bit for oil and gas well drilling has cutting elements set in a hard facing material which in turn is supported by a sintered steel section between the hard facing and the steel base of the bit.

12 Claims, 10 Drawing Figures

DRILL TOOL FOR DEEP WELLS

FIELD OF THE INVENTION

The subject of the invention is a rotary drill tool for deep wells consisting of a threaded stud for a connection with a drill string or with a steel connecting body including a similar rotary drive, whose head is provided with cutting members, which extend from the base region of the head into its retracted central region, which are collected in projecting row or strip-like groups over the exterior surface of the tool and are supported in a bonding substance.

DESCRIPTION OF THE PRIOR ART

In known rotary drill tools of this type, the cutting members of natural or synthetic diamond or polycrystalline diamond are supported in a matrix bonding substance which is mounted on the steel connecting body. Usually tungsten carbide alloyed with copper is used as the bond in the matrix bonding substance. This material possesses a high erosion and abrasion resistance but is very expensive due to its cemented carbide content.

In spite of this, a great layer thickness is required to absorb the thermal stresses which arise in the manufacturing process to prevent crack formation, so that the amount of expensive and scarce matrix material required is attributable as a disadvantage of known rotary drill tools.

SUMMARY OF THE INVENTION

The task which is basic to the invention consists, with a rotary drill tool of the above-named type, of arranging the matrix bonding compound in such a way that the proportion of expensive material can be reduced without reducing the mechanical properties of the tool.

This task is solved in a rotary drill tool of the above-named type by the fact that the arrangement of the matrix bonding substance in the region of the protruding strip or row-like groups with cutting members or cutting coatings is reduced, that the matrix bonding substance is formed as a layer, and that the space between the above-named layer and the steel connecting body is provided with a filler, e.g., steel.

The web or rib-like construction of the blades which surround the matrix bonding subtance has as a consequence that thermal stresses can appear at the circumference only partially. Therefore, no addition to the share of thermal stress ensues and the dreaded layer cracks are avoided. The thickness of the matrix bonding layer itself can be reduced with the above-mentioned construction of the blades if the compound is replaced by filler in the core region. Saving of matrix material thus occurs in twofold consideration.

Steel, for example is a suitable filler, with which the space between the matrix bonding compound layer and the steel connecting body is filled and subsequently bonded by means of a sintering process.

A special advantage of this intermediate layer lies in the buffering effect relative to the steel connecting body which expands against the graphite mold during the heating process.

The matrix bonding compound may be applied to the surface as a uniformly thick layer in a tangential direction and orthogonal to it if it is expected that the formation of uniform abrasion will occur in the application of the rotary drill tool or also adjusted according to the degree of the abrasion and erosion forces occurring at various locations of the tool during drilling. In addition, a choice of various abrasion-resistant material may be made taking the expected wear forces into consideration.

In all the above-mentioned design forms, preformed wear-resistant supporting bodies may be inserted into the matrix bonding compound or into the filler, onto which diamond layer cutting elements (e.g., sintered polycrystalline diamond) may be soldered after the manufacturing process of the tool body.

Similarly, man-made or natural diamonds may be set into the surface of the matrix layer or small caliber diamonds may be impregnated directly into the matrix bonding compound. Beyond this, combinations of the above-mentioned cutting materials are possible.

The nozzles or gutters, with passage channels to a central hole which are usual for removal of drill cuttings and cooling the cutting, may be inserted into the matrix material or shaped out of the matrix substance and, if desired, out of the filler.

In a special design form of the nozzles, the passage channels are directed out to the surface of the tool with a constant cross-section, and, preferentially, have a relationship to diameter to length in the region between 0.5 and 0.1.

If, in the case of certain blade proportions, the surface area of the steel connecting body usuable for bonding must be enlarged, ridges can be welded into the connecting body in the region of the blades or studs may be recessed as projections during machining of the steel body.

Ridges or ribs are required when the relationship of blade circumferential width to blade radial height is unity or less than unity. Wear protection of the base material between the ribs, which becomes necessary due to the tool geometry or drilling conditions may be achieved by jacketting the base material with an anti-wear lining of suitable materials by welding, flame or plasma spraying onto the steel connecting body.

Additional characteristics and advantages of the invention are shown in the claims and in the following description in connection with the drawing, in which construction examples of the subject of the invention are illustrated. In the drawing are shown:

DESCRIPTION OF THE PREFERRED EMBODIMENTS

Figure 1:
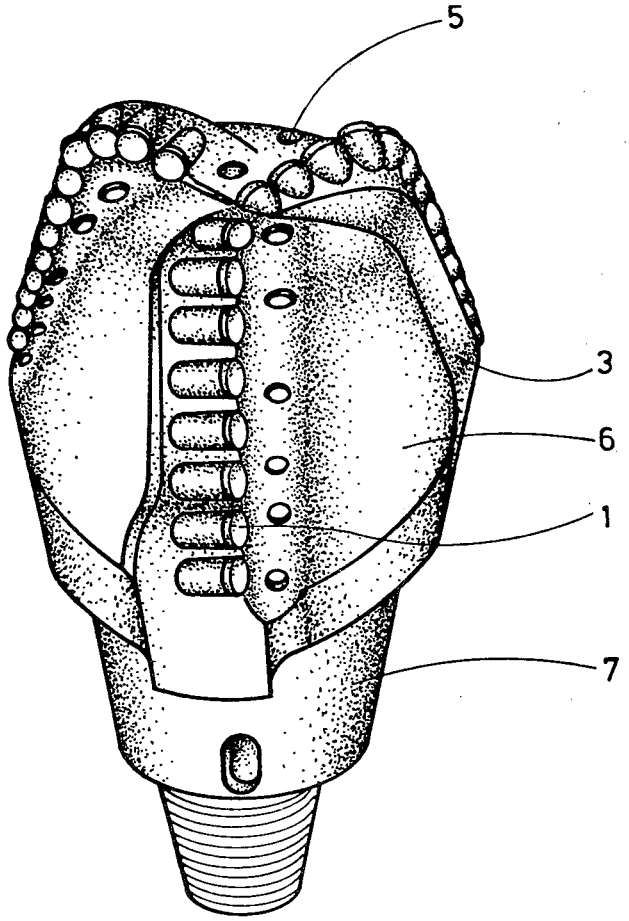
FIG. 1 is a graphic representation of a first rotary drill tool with blades which are formed as studs and which carry preformed cutting layers fastened to supports. The flushing fluid is conducted through nozzles.

In FIG. 1, a rotary drill tool is represented which includes a steel connecting body 7 and three stud shaped blades which, at times, extend from the outer radius of the tool to the center. The blades have preformed cutter tips with polycrystalline sintered diamond which are fastened to the supports which are partially inserted into the stud and the whole designated as 1.

Inside the steel connecting body 7, a central drilled hole and passage channels for the flush are provided to supply the tool with flushing liquid. These flow into nozzles 5.

The blades inside the nozzles are exposed to strong abrasive forces during drilling and have an abrasion and erosion-resistance surface made of matrix bonding substance 3. The remainder of the steel body is unprotected or provided with an anti-wear lining 6 by welding, flame or plasma spraying a suitable material onto the connecting body.

Figure 4:
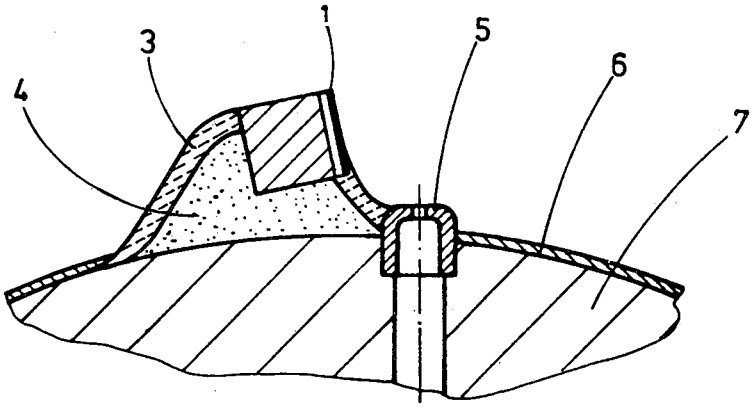
FIGS. 4 and 5 show cross-sections through various construction designs of a rotary drill tool according to FIG. 1.
Figure 5:
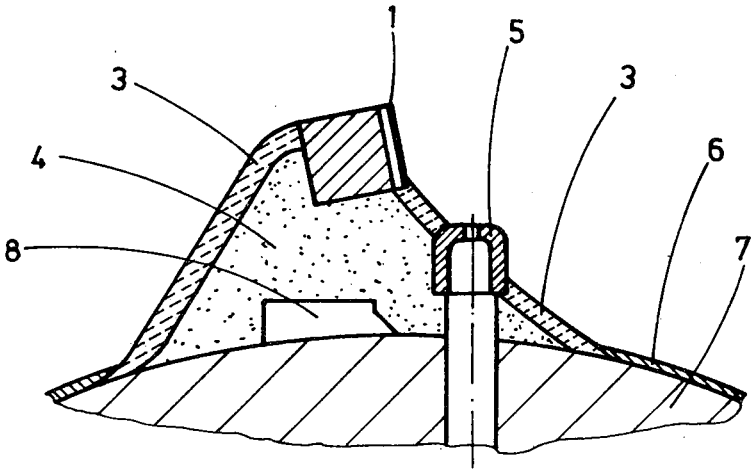

For visualization of the buildup of a stud, cross-sections through a stud according to the design of FIG. 1 are represented in FIGS. 4 and 5. A stud with a blade part, the whole designated as 1, is arranged on a steel connecting body 7. The stud consists of an outer layer of matrix bonding compound 3, which, as described above, is very abrasion and erosion-resistant through the addition of a wear-resistant material, e.g., a carbide. On the other hand, an inner core 4 is composed of steel which is bonded by means of sintering processes with or without the addition of binder.

In addition to main use as a mount and support for the blade members 1, the matrix bonding compound 3 or the steel core 4 serves also to protect the nozzles 5, which convey the flushing liquid. The remainder of the steel connecting body can be provided with an armored coating 6, which as already described above, can be applied by welding, flame or plasma spraying a suitable material onto the connecting body.

The difference between the stud illustrated in FIG. 5 and the one in FIG. 4 consists of its greater height. This stud has a strip 8 to enlarge the usable area for bonding to the steel connecting body 7, which, for example, was welded onto the steel connecting body 7 or was recessed as a projection during manufacture.

Figure 2:
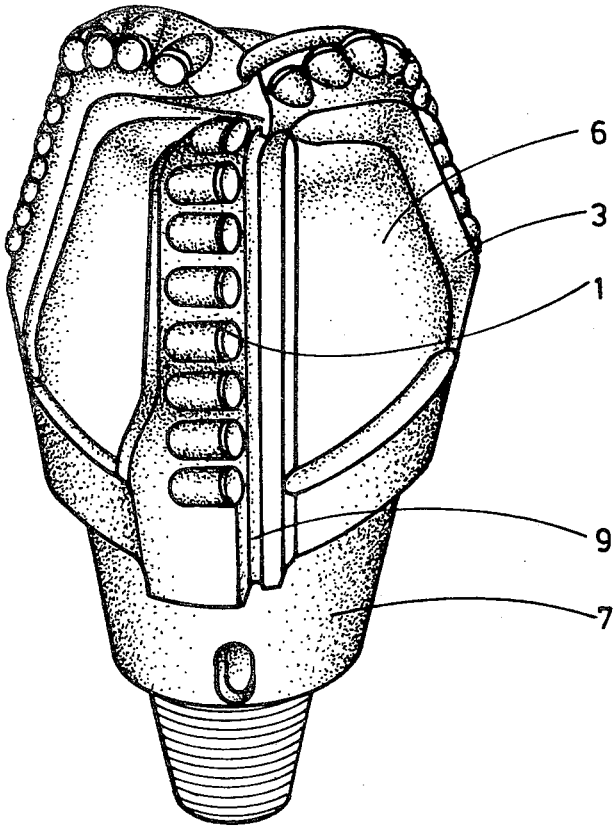
FIG. 2 is a second rotary drill tool, whose blades are formed as those in FIG. 1, but in which the flushing liquid is conducted by way of gutters.
Figure 6:
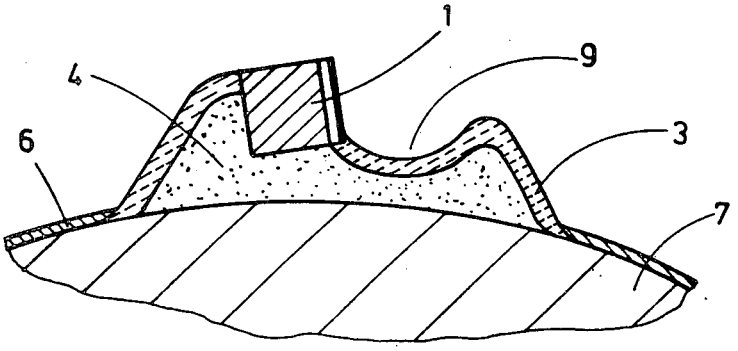
FIGS. 6, 7 and 8 show cross-sections through various construction designs of a rotary drill tool according to FIG. 2.
Figure 7:
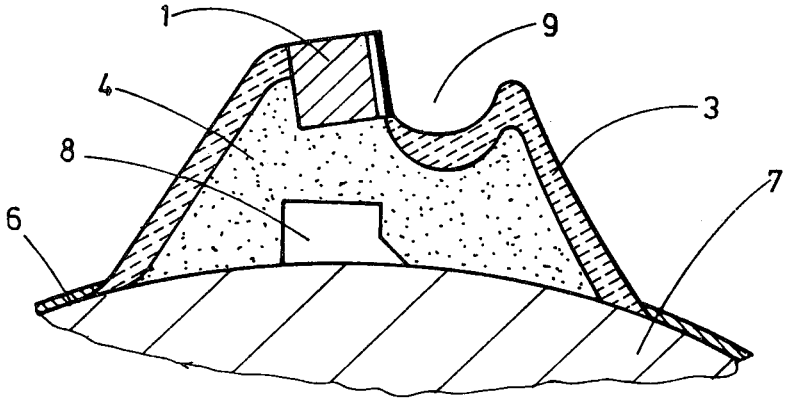
Figure 8:
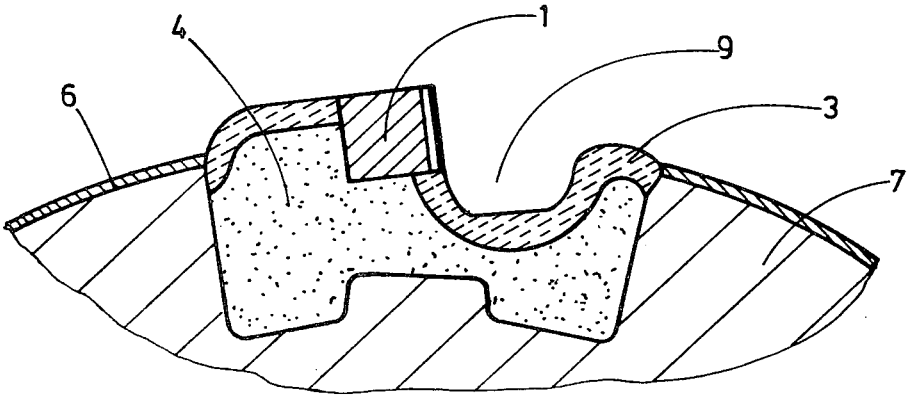

Examples of how a partially produced matrix bonding substance 3 with steel core 4 is also suitable for the production of other tool shapes are given in the second tool illustrated in FIG. 2 as well as in the appropriate cross-sections of FIGS. 6, 7, 8. While maintaining the blade members 1 described in connection with FIGS. 1, 4 and 5, open gutters (9) are provided on the outside instead of nozzles. The gutters are inserted or shaped into the matrix bonding substance and which flow into the passage channels connecting with the central hole in the interior of the tool. The outer, abrasion resistant, layer of the gutters 9 is co-drawn into the interior following the outer contour, so that approximately equal thickness of abrasion resistant material is encountered on all the surface locations of the stud including the inserted gutters. A strip 8 according to FIG. 7 is provided when the height of the stud is greater, which fulfills the same purpose as that described in connection with the design in FIG. 5.

FIG. 8 shows a design of a stud of low height, where a recess exists in the steel connecting body 7 to receive the matrix bonding substance 3 and the steel core 4.

Figure 3:
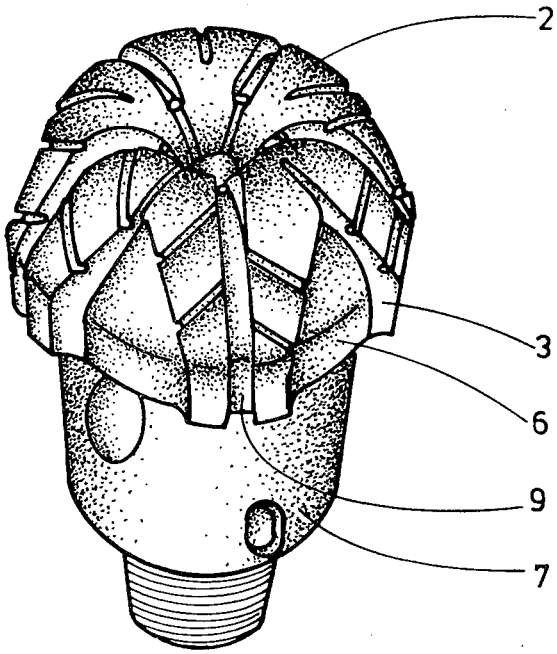
FIG. 3 is a third rotary drill tool with flat studs, whose tangential surface contains cutting particles and form a cutting layer and which are perforated by waterways according to a defined configuration.

In a third drill tool, according to FIG. 3, instead of prefabricated, precisely positioned blade members, layers made of a cutting material with, for example, natural diamonds bonded into the matrix bonding substance are formed as the outer tangential surface of the ribs and form a cutting coating 2. This cutting coating 2 is interrupted and passed through in a kind of tire trend profile by gutters 9, into which, as described with the second rotary drill tool (FIG. 2) the channels connecting with the central hole flow.

Figure 9:
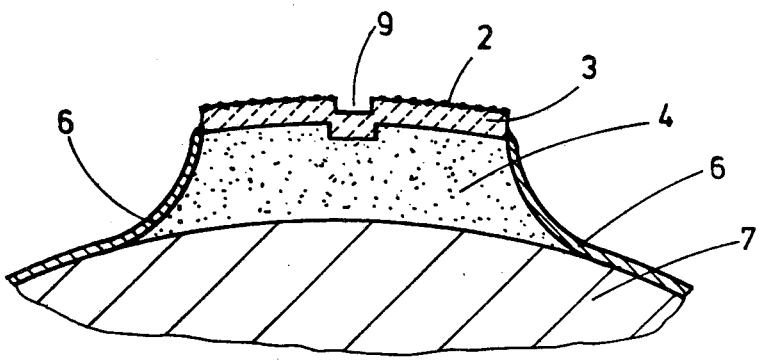
FIGS. 9 and 10 show cross-sections through various construction designs of a rotary drill tool according to FIG. 3.
Figure 10:
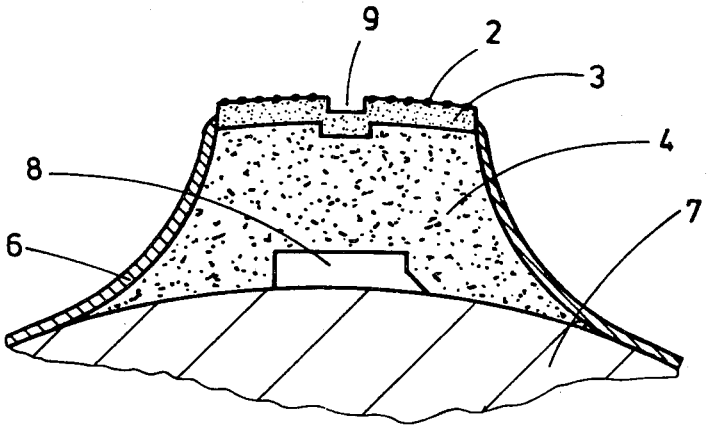

The design represented in cross-section in FIGS. 9 and 10, on the other hand, corresponds to the remaining design shapes which have been dealt with, with respect to the arrangement of the matrix bonding substance 3 and the steel core 4.

What is claimed is:

1. Rotary drill tool for deep well drilling, consisting of a steel connecting body which includes a threaded stud to connect with a drill bed or similar rotary drive, whose head is provided with cutting members and/or cutting coatings, which extend from the base region of the head to its central region, combined in row or strip-like protruding groups upon the external circumference and supported in a matrix bonding substance, characterized by the fact that the arrangement of the matrix bonding substance is confined with cutting members (1) and/or cutting coatings (2) in the region of the protruding strip or row-like groups, the matrix bonding substance (3) is formed as a layer and a space between the said layer and the steel connecting body (7) is provided with a sintered steel filler.

2. Rotary drill tool according to claim 1 characterized by the fact that the thickness of the matrix bonding substance layer is adjusted according to the degree of abrasion and erosion forces which occur at various locations of the tool during drilling.

3. Rotary drill tool, according to claim 1, characterized by the fact that passage channels for flushing liquid connected with a central hole in the steel connecting body are provided, which flow into nozzles, where the nozzles are arranged ahead of the cutting members in the rotation direction of the tool and are protected by the matrix bonding substance.

4. Rotary drill tool according to claim 3, characterized by the fact that the nozzles are shaped and formed integrally from matrix bonding substance.

5. Rotary drill tool according to claim 3, characterized by the fact that the nozzles are formed from the passage channels and have a constant cross-section over the length.

6. Rotary drill tool according to claim 1, characterized by the fact that one or more passage channels for flushing liquid are provided with a central hole into the steel connecting body, which channels flow into gutters which are open on the outside, that the drains are imbedded in the matrix bonding substance and in the filler, and thereby the layer shape of the matrix bonding substance follows the contour of the drains.

7. Rotary drill tool according to claim 1, characterized by the fact that the cutting members are formed from cutting laminae with polycrystalline sintered diamond or impregnated cutting elements, which for their part are fastened to supports.

8. Rotary drill tool according to claim 1, characterized by the fact that the cutting coatings consist of natural or synthetic or a combination of both kinds of diamond, which are impregnated into the matrix bonding substance and/or are set into its surface.

9. Rotary drill tool according to claim 1, characterized by the fact that both cutting members from cutting laminae with polycrystalline sintered diamond or impregnated cutting elements, which for their part are fastened to supports, as well as cutting members or cutting coatings of natural or synthetic or a combination of both kinds of diamond which are impregnated into the matrix bonding substance and/or set into its surface are provided.

10. Rotary drill tool according to claim 1, characterized by the fact that strips are produced on the connecting body or are recessed during the fabrication of the connecting body to enlarge the surface area usable for bonding between the steel connecting body and the filler.

11. Rotary drill tool according to claim 1, characterized by the fact that an armored lining of abrasion and erosion-resistant material is provided between the protruding strip or row-like groups.

12. Rotary drill tool according to claim 11, characterized by the fact that the armored lining is made of a hard coating which, for example, can be formed by welding, flame or plasma spraying.

* * * * *